US012110768B2

(12) United States Patent
Cho et al.

(10) Patent No.: US 12,110,768 B2
(45) Date of Patent: Oct. 8, 2024

(54) MULTILATERAL COMPLETION SYSTEMS AND METHODS TO DEPLOY MULTILATERAL COMPLETION SYSTEMS

(71) Applicant: Halliburton Energy Services, Inc., Houston, TX (US)

(72) Inventors: Brian Williams Cho, Katy, TX (US); Clifford Allen, Spring, TX (US); Kjetil Oeien Borgersen, Slependen (NO); Loc Phuc Lang, Arlington, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 0 days.

(21) Appl. No.: 17/075,421

(22) Filed: Oct. 20, 2020

(65) Prior Publication Data

US 2021/0156233 A1 May 27, 2021

Related U.S. Application Data

(60) Provisional application No. 62/938,840, filed on Nov. 21, 2019.

(51) Int. Cl.
*E21B 41/00* (2006.01)
*E21B 17/02* (2006.01)

(52) U.S. Cl.
CPC ..... *E21B 41/0035* (2013.01); *E21B 17/0283* (2020.05)

(58) Field of Classification Search
CPC ..... E21B 41/0035; E21B 17/0283
See application file for complete search history.

(56) References Cited

U.S. PATENT DOCUMENTS 6,209,648 B1 * 4/2001 Ohmer ..... E21B 41/0042 166/380
6,515,592 B1 2/2003 Babour et al.
(Continued)

FOREIGN PATENT DOCUMENTS

RU 2651677 C1 4/2018
WO WO-2018118028 A1 * 6/2018 ..... E21B 17/023
WO 2019059885 3/2019

OTHER PUBLICATIONS

International Search Report and Written Opinion issued in corresponding PCT Application No. PCT/US2020/056894; mailed Dec. 15, 2020.

*Primary Examiner* — Nicole Coy
(74) *Attorney, Agent, or Firm* — Barnes & Thornburg LLP

(57) ABSTRACT

The disclosed embodiments include multilateral completion systems and methods to deploy multilateral completion systems. A multilateral completion system includes a main bore completion having an inductive coupler, a lateral completion having an inductive coupler, and a second lateral completion also having an inductive coupler. The multilateral completion system also includes a junction having an inductive coupler, and a second junction having an inductive coupler. The multilateral completion system further includes a final completion having a first inductive coupler electrically connected to the inductive coupler of the main bore completion, a second inductive coupler electrically connected to the inductive coupler of the lateral completion, a third inductive coupler configured to couple to the inductive coupler of the second junction, and an electrical conduit running through an inner diameter of the junction, whereby the main bore completion, the lateral completion and the second lateral completion are all electrically connected in parallel.

19 Claims, 13 Drawing Sheets

(56) References Cited

U.S. PATENT DOCUMENTS

| | | | | |
|---|---|---|---|---|
| 6,684,952 | B2 | 2/2004 | Brockman et al. | |
| 6,768,700 | B2 | 6/2004 | Veneruso et al. | |
| 6,789,628 | B2 | 9/2004 | Hess et al. | |
| 7,165,618 | B2 | 1/2007 | Brockman et al. | |
| 7,735,555 | B2 | 6/2010 | Patel et al. | |
| 7,793,718 | B2 | 9/2010 | Patel et al. | |
| 7,900,705 | B2 * | 3/2011 | Patel | E21B 43/12 166/50 |
| 8,056,619 | B2 | 11/2011 | Patel et al. | |
| 8,074,743 | B2 | 12/2011 | Patel | |
| 9,249,559 | B2 | 2/2016 | Dyer et al. | |
| 10,087,718 | B2 | 10/2018 | Steele et al. | |
| 10,175,377 | B2 | 1/2019 | Johannessen | |
| 2003/0058127 | A1 | 3/2003 | Babour et al. | |
| 2004/0094303 | A1 | 5/2004 | Brockman et al. | |
| 2004/0159429 | A1 | 8/2004 | Brockman | |
| 2009/0008078 | A1 | 1/2009 | Patel | |
| 2011/0011580 | A1 | 1/2011 | Clark et al. | |
| 2013/0075087 | A1 * | 3/2013 | Algeroy | E21B 47/12 166/250.01 |
| 2013/0192851 | A1 | 8/2013 | Algeroy et al. | |
| 2017/0107794 | A1 | 4/2017 | Steele | |
| 2021/0140276 | A1 * | 5/2021 | Steele, Jr. | E21B 41/0035 |

* cited by examiner

MULTILATERAL COMPLETION SYSTEMS AND METHODS TO DEPLOY MULTILATERAL COMPLETION SYSTEMS

BACKGROUND

The present disclosure relates generally to multilateral completion systems and methods to deploy multilateral completion systems.

A lateral borehole is sometimes drilled from a main borehole to improve hydrocarbon production. After the lateral borehole is drilled, production tubing is deployed in both the main borehole and the lateral borehole to increase hydrocarbon production.

BRIEF DESCRIPTION OF THE DRAWINGS

Illustrative embodiments of the present disclosure are described in detail below with reference to the attached drawing figures, which are incorporated by reference herein, and wherein:

FIGS. 2A'-2I' are circuit diagrams of electrical conduits of components of the multilateral component system illustrated in FIGS. 2A-2I;

Figure 1:
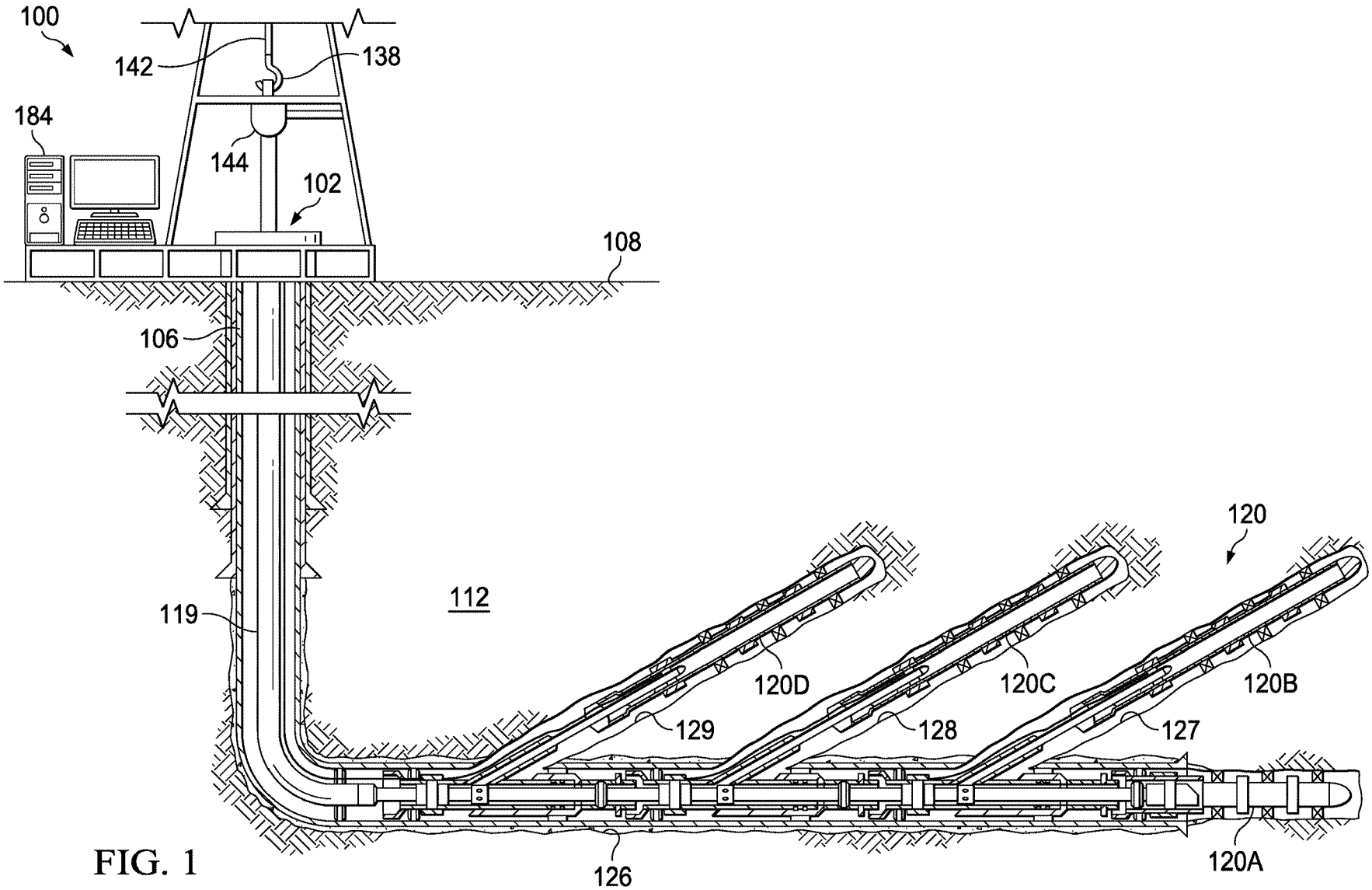
FIG. 1 is a schematic, side view of a completion environment in which a multilateral completion system is deployed in a main borehole and three lateral boreholes of a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to multilateral completion systems and methods to deploy multilateral completion systems. A multilateral completion system includes a main bore completion that is deployed in a main bore of a multilateral wellbore, and at least one lateral completion deployed in a respective lateral borehole of the multilateral wellbore. Each of the main bore completion and lateral completion includes an inductive coupler, which, when connected to an electrical conduit (such as an electrical conduit of an adjacent junction) or another component (such as another inductive coupler) of the multilateral completion system, electrically connects one or more components of the main bore completion or the lateral completion to another component of the multilateral completion system. As referred to herein, an inductive coupler includes any conductor that is configured inductively couple to another conductor. In some embodiments, an inductive coupler is a male piece or component having a conductor that is configured to inductively couple to a female piece or component also having a conductor. In some embodiments, an inductive coupler is a female piece or component having a conductor that is configured to inductively couple to a male piece or component also having a conductor. Additional examples of inductive couplers are provided herein, and are illustrated in at least FIGS. 3A-3D. As referred to herein, components of the main bore completion or the lateral bore completion include electrical components (such as sensors, and other electrical devices), mechanical components (such as valves and other types of mechanical devices), electromechanical components, fluidic components, chemical components, and other types of devices deployable on the main bore completion or on a lateral completion. Further, and as referred to herein, an electrical conduit is a conduit (such as a wire) that electrically connects different components of the multilateral completion system. Additional descriptions of the main bore completion and the lateral completions are provided in the paragraphs below.

The multilateral completion system also includes at least one junction, each having an inductive coupler configured to couple to an inductive coupler of a lateral completion. In the embodiment where the multilateral completion system includes one or more lateral completions with an inductive coupler, the multilateral completion system includes a unitary junction having two inductive couplers, one in the main borehole and one on the lateral leg and a cable bypass connecting the set of inductive couplers which, when coupled to an inductive coupler of the lateral completion, electrically connects the main borehole to the lateral completion. Further, where the multilateral completion system includes a second lateral completion, the multilateral completion system also includes a second junction having a second set of inductive couplers which, when coupled to an inductive coupler of the second lateral completion, electrically connects the main borehole to the second lateral completion. In the primary embodiments, electrical conduits connecting all lateral completions are run through an inner diameter of the junctions completing a fault tolerant parallel connected multilateral. The foregoing reduces or eliminates the likelihood of electrical conduits being cut during drilling operations, and also reduces or eliminates additional considerations that are made to avoid cutting electrical conduits during the drilling operations. A final completion having a series of inductive couplers is run into the main borehole of the multiple lateral wellbore to electrically connect the main bore completion and each lateral completion. As referred to herein, a final completion may be a completion string, a coiled tubing, a drill pipe, a production tubing, a work string, or another type of conveyance that is deployable in a main borehole of a multiple lateral wellbore. In some embodiments, final completion is also retrievable from the wellbore, and is re-deployable at a later time. The inductive couplers on the final completion are spaced out such that they land across from the main bore inductive couplers (such as inductive couplers of junctions deployed in the main borehole as shown in FIG. 2I), establishing a parallel connection of the main bore completion and each lateral completion. Additional descriptions of deploying the final completion and forming parallel connections of the main bore completion and one or more lateral completions are described herein, and are illustrated in at least FIGS. 2I and 2I'.

In some embodiments, one or more tests are performed on the multilateral completion system during well construction. In one or more of such embodiments, a tool (such as a running tool) having a test apparatus is deployed into the multilateral wellbore. As referred to herein, a test apparatus is any device or component configured to test one or more components (such as sensors, valves, inductors, capacitors, electrical conduits, restrictors, power sources, and other components) of the multilateral completion system. In one or more of such embodiments, one or more tests are performed on the main completion, each lateral completion, and each junction landing to determine whether the main completion, the lateral completions, and the junctions are electrically connected. In one or more of such embodiments, tests are performed on different components of the main completion, lateral completions, and junctions to determine whether the components are electrically connected and the operational status of the respective components. In one or more of such embodiments, a determination of whether tests on different components of the multilateral system meet or exceed a threshold performance level of the respective components is made, and the final completion is deployed into the multilateral wellbore after a determination that all or a threshold number of components of the multilateral system have met or have exceeded the threshold performance level is made. Additional descriptions of multilateral completion systems, and methods to deploy a multilateral completion system are provided in the paragraphs below and are illustrated in at least FIGS. 1-4.

Now turning to the figures, FIG. 1 is a schematic, side view of an environment 100 in which a multilateral completion system 120 is deployed in a main borehole 126, and three lateral boreholes 127-129 of a wellbore 106. In the embodiment of FIG. 1, a main bore completion 120A, a first lateral completion 120B, a second lateral completion 120C, and a third lateral completion 120D, are deployed in main bore hole 126, and lateral boreholes 127-129, respectively. In the embodiment of FIG. 1, a well 102 having wellbore 106 extends from a surface 108 of well 102 to or through a formation 112. A hook 138, cable 142, traveling block (not shown), hoist (not shown), and top drive 144 are provided to lower a final completion 119 down wellbore 106 of well 102 or to lift final completion 119 up from wellbore 106 of well 102. In the embodiment of FIG. 1, final completion 119 has an internal cavity that provides a fluid flow path from surface 108 to a downhole location.

In some embodiments, final completion 119 also provides telemetry of data indicative of one or more parameters of the well operation or of the well 102. In one or more of such embodiments, a telemetry system is deployed in wellbore 106 to transmit data from multilateral completion system 120 and other downhole components. As referred to herein, communication system 184 is any electronic device that is operable to perform operations described herein to communicate with multilateral completion system 120 and/or to determine the health of multilateral completion system 120. In some embodiments, one or more processors of communication system 184 performs the operations described herein. For example, the processors transmit requests to a testing tool (not shown) to test components of multilateral completion system 120, and determines, based on results of the one or more tests, the status of one or more components of multilateral completion system 120. In the embodiment of FIG. 1, communication system 184 is a surface-based electronic device that includes one or more processors operable to deploy multilateral completion system 120.

FIG. 1 illustrates main borehole 126 as a horizontal borehole for illustration purposes. In some embodiments, main borehole 126 has a directional, tortuous, or a different shape. In some embodiments, main borehole 126 is a lateral borehole of another main borehole (not shown) or another lateral borehole. Although FIG. 1 illustrates three lateral boreholes 127-129, in some embodiments, wellbore 106 includes a different number of lateral boreholes (not shown). Further, although communication system 184 of FIG. 1 is illustrated as a surface-based electronic device, in some embodiments, communication system 184 is located downhole or is located in another surface-based location remote from well 102. Further, although FIG. 1 illustrates uncased lateral boreholes 127-129, in some embodiments, lateral boreholes 127-129 are cased before multilateral completion system 120 is deployed in wellbore 106. FIG. 1 illustrates an already deployed multilateral completion system 120. Description of operations performed to deploy a multilateral completion system, such as multilateral completion system 120 of FIG. 1, are provided in the paragraphs below and are illustrated in at least FIGS. 2A-2I. Further, illustrations of circuit diagrams of electrical conduits of components of multilateral completion system 120 during different stages of deployment are illustrated in FIGS. 2A'-2I'.

A main borehole is first drilled through the formation, such as formation 112 of FIG. 1. A main bore completion is then run into the main borehole of well 102. In that regard, FIG. 2A illustrates main bore completion 120A of multilateral completion system 120 of FIG. 2A deployed in main borehole 126 of wellbore 106. Main bore completion 120A includes a component 202 (such as a valve, a sensor, or another type of component) and an inductive coupler 204 configured to provide electrical conduit to components of main bore completion 120A. In the embodiment of FIG. 2A, inductive coupler 204 is a female. In the embodiment of FIG. 2A, a portion of main borehole 126 is cased, and a portion of main borehole 126 is not cased. FIG. 2A' is a circuit diagram of an electrical conduit of the multilateral completion system illustrated in FIG. 2A. In the embodiment of FIG. 2A', line 252 represents an electrical conduit from inductive coupler 204 of FIG. 2A to other components of main bore completion 120A.

Figure 2A:
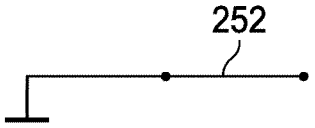
FIGS. 2A-2I are schematic, cross-sectional views of the multilateral completion system of FIG. 1 during different stages of deployment of the multilateral completion system into the wellbore.
Figure 2A:
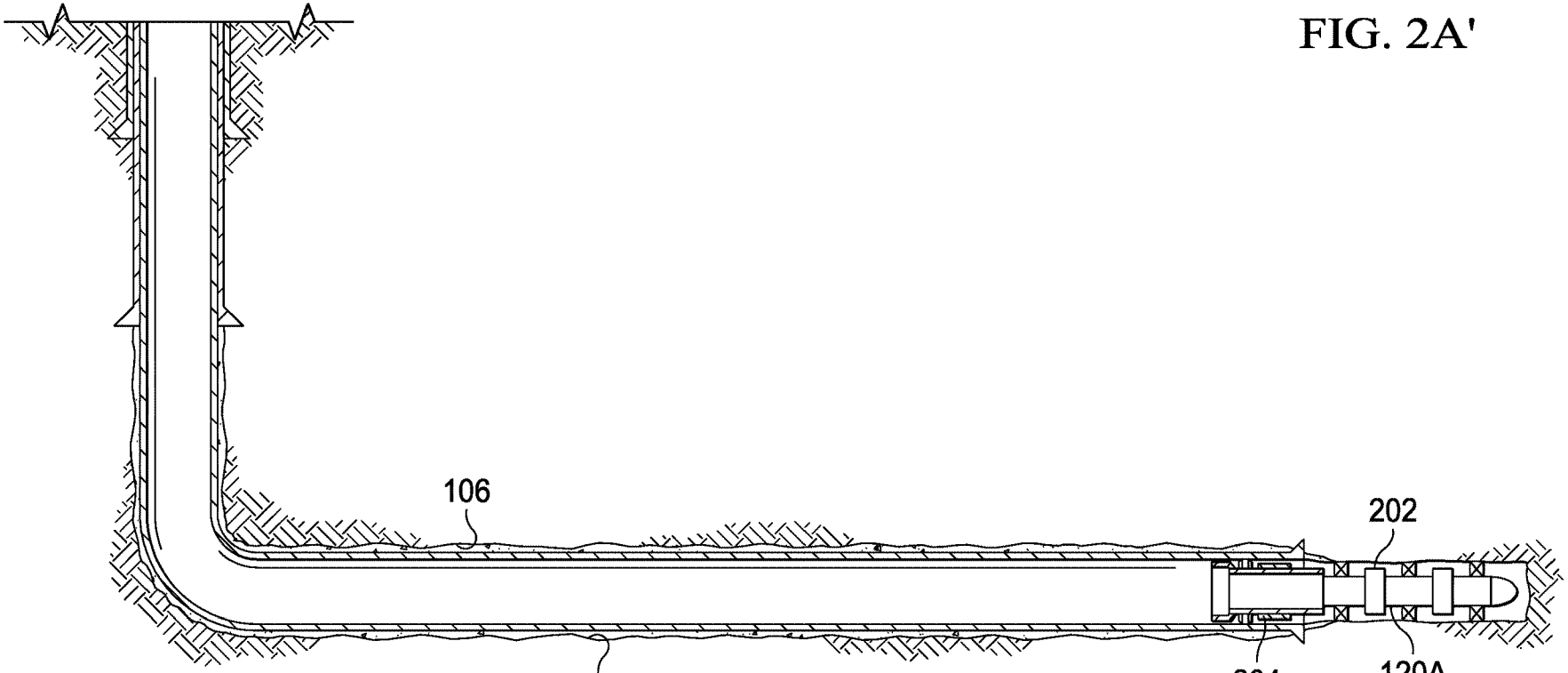
Figure 2B:
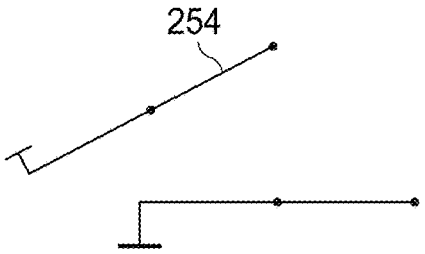
Figure 2B:
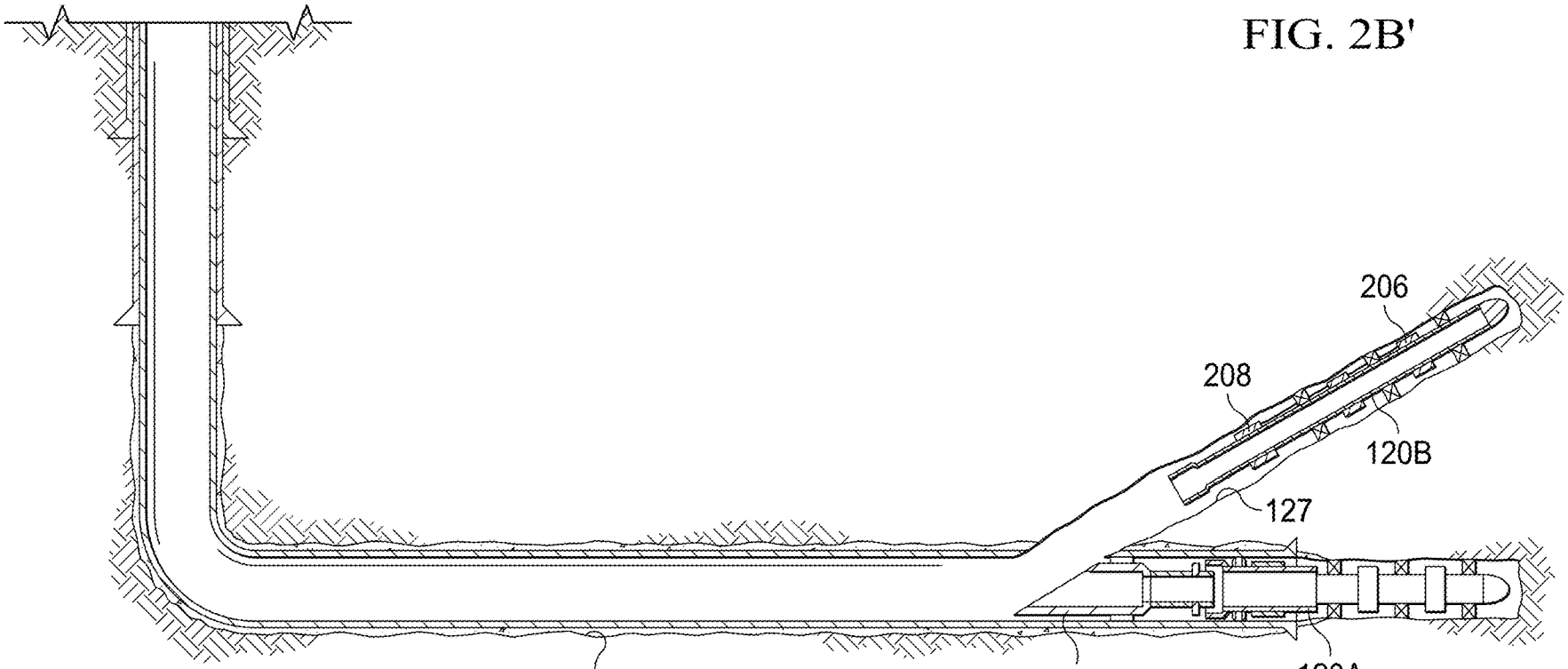

A lateral wellbore is constructed using the typical process of cutting a window in the main bore casing and drilling the lateral, such as lateral borehole 127 is drilled through the formation and a lateral completion of multilateral completion system 120 of FIG. 2A is run into the lateral wellbore. In that regard, FIG. 2B illustrates a first lateral completion 120B deployed in lateral borehole 127 of wellbore 106. First lateral completion 120B includes a component 206 (such as a valve, a sensor, or another type of component) and an inductive coupler 208 configured to provide electrical conduit to components of first lateral completion 120B. In that regard, FIG. 2B' is a circuit diagram of electrical conduits of the multilateral completion system illustrated in FIG. 2B. In the embodiment of FIG. 2B', line 254 represents an electrical conduit from inductive coupler 208 of FIG. 2B to component 206 of FIG. 2B and other components (such as additional sensors and valves) of first lateral completion 120B.

A junction with lateral connectivity is then run into the main borehole and the lateral borehole. In that regard, FIG.

Figure 2C:
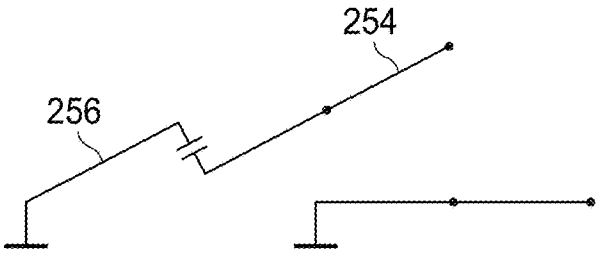
Figure 2C:
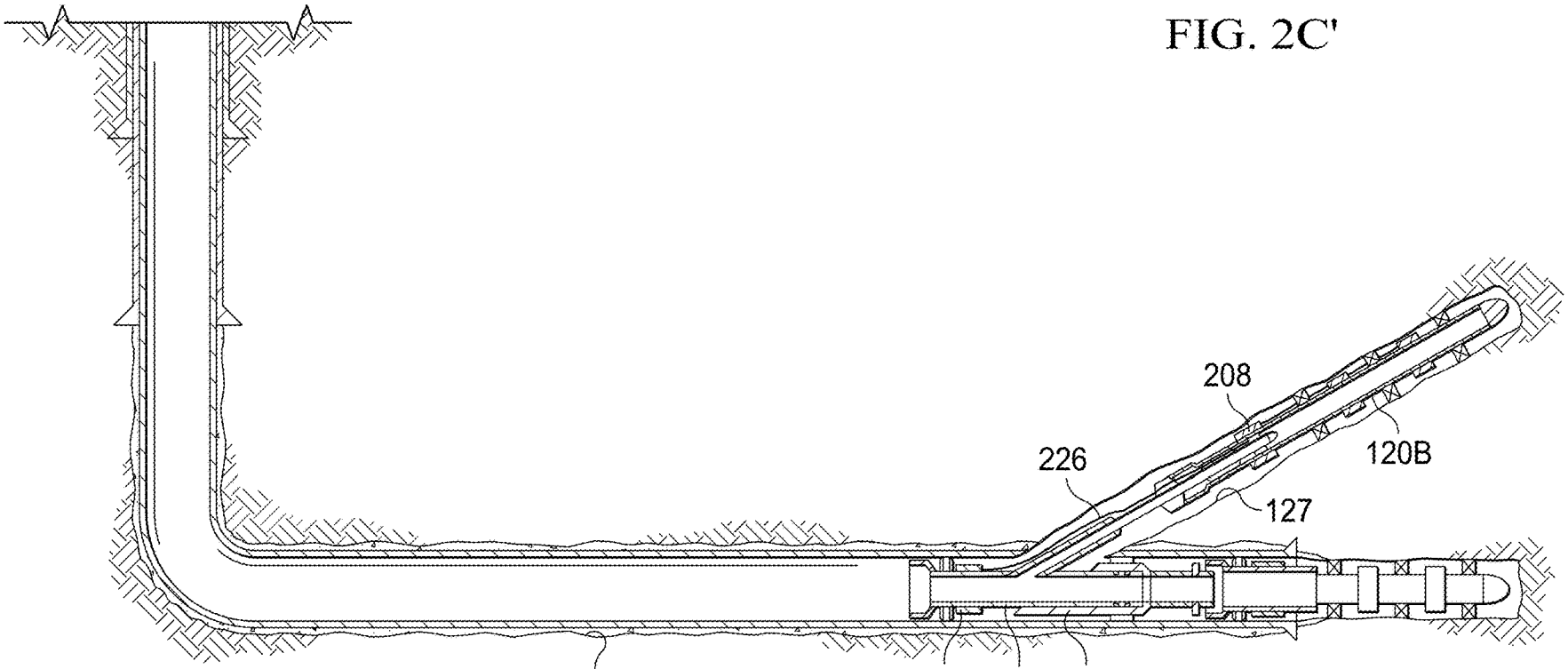

2C illustrates a first junction 222 having an inductive coupler 224 and an electrical conduit 226 deployed near a junction of main borehole 126 and lateral borehole 127. In the embodiment of FIGS. 2B and 2C, first function 222 is inserted directly into a diverter 211. Further, electrical conduit 226 runs through an inner diameter of lateral borehole 127 and is connected to inductive coupler 208 to electrically connect components of first lateral completion 120B. In that regard, FIG. 2C' is a circuit diagram of electrical conduits of the multilateral completion system illustrated in FIG. 2C. In the embodiment of FIG. 2C', line 256 represents electrical conduit 226 from inductive coupler 224 as illustrated in FIG. 2C to inductive coupler 208 as illustrated in FIG. 2C. Further, electrical conduit 226 is electrically connected to the electrical conduit from inductive coupler 208 to the components of first lateral completion 120B as represented by line 254.

Figure 2D:
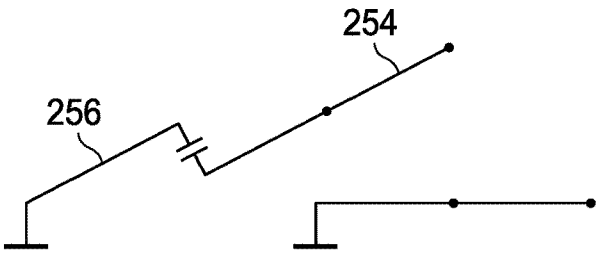
Figure 2D:
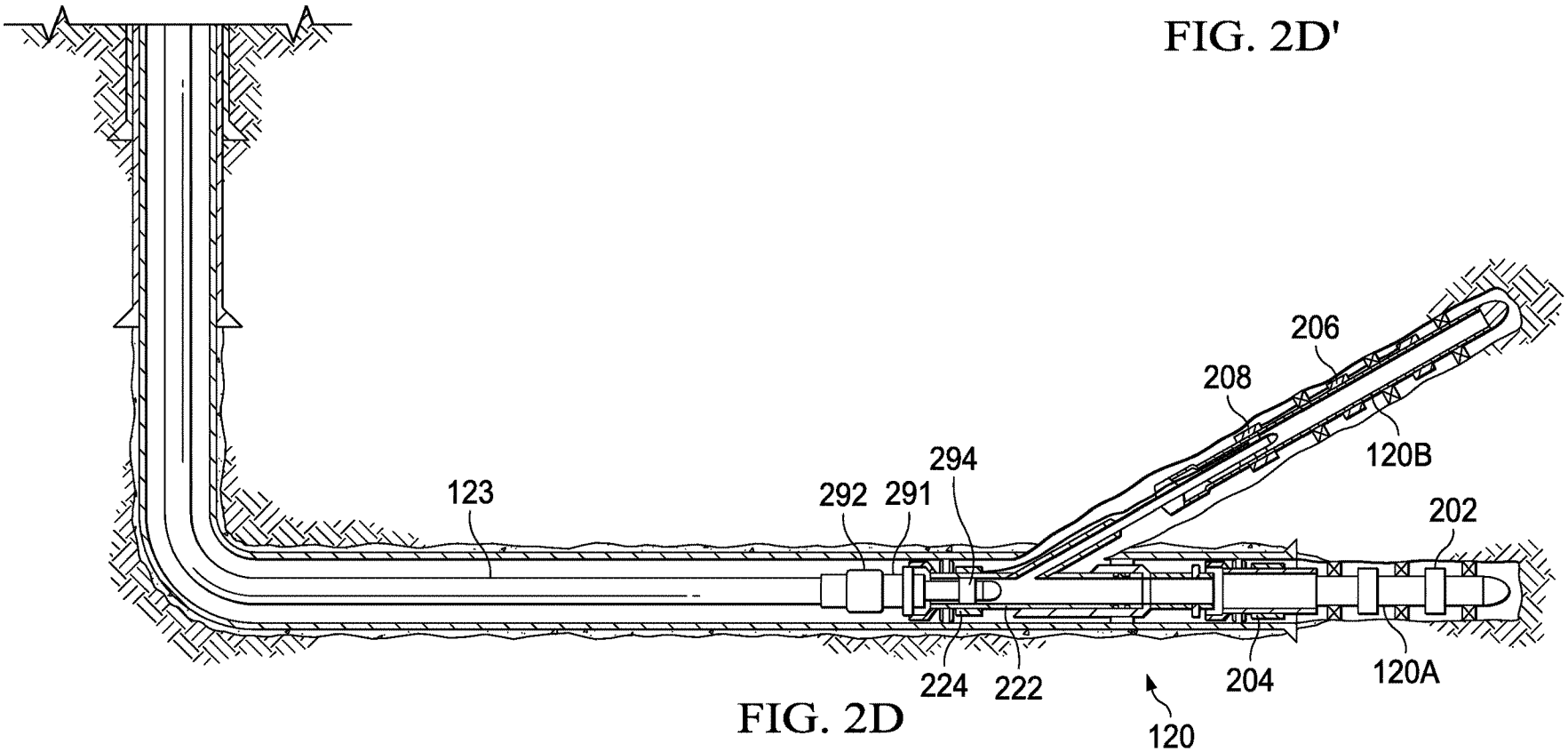

In some embodiments, one or more tests of lateral completion systems dropped off in the lateral are performed. In that regard, FIG. 2D illustrates an example of running first junction 222 and a work string 123 having a running tool 291. Running tool 291 has a communication module 292 that is coupled to a male inductive coupler 294 which mates with a female inductive coupler 224 to perform communication tests through inductive coupler 208 to determine the status, health, and/or performance of components 206. In some embodiments, test results are transmitted uphole via the communication module 292, such as via work string 123, via wireless transmission, via acoustic transmission, or other methods of transmission uphole to communication system 184 of FIG. 1. After confirming the connectivity, the running tool 291 is released and work string 123 is lifted to the surface. In the embodiment of FIG. 2D, inductive coupler 294 is coupled to or is a component of a test apparatus. In some embodiments, other types of test apparatuses are utilized to perform tests on components 206. In some embodiments, a running tool equipped to perform tests of components of multilateral completion system 120 is run into main bore completion 120A or other junctions of multilateral completion system 120.

FIG. 2D' is a circuit diagram of electrical conduits of the multilateral completion system illustrated in FIG. 2D. In the embodiment of FIG. 2D', electrical conduits represented by lines 254 and 256 are tested by communication module 292 of FIG. 2D to determine the connectivity, health, and status of the electrical conduits. In some embodiments, where a multilateral completion system does not include any additional lateral completions, a final completion similar to final completion 119 of FIG. 1 is deployed in the wellbore to electrically connect the final completion with the main bore completion and the first lateral completion. Additional descriptions of deploying the final completion and electrically connect the final completion with components of the multilateral completion system are provided herein and are illustrated in FIG. 2I.

Figure 2E:
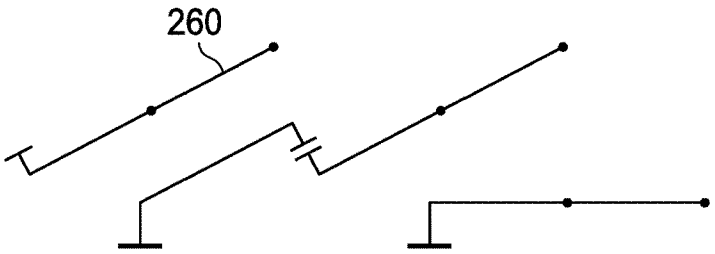
Figure 2E:
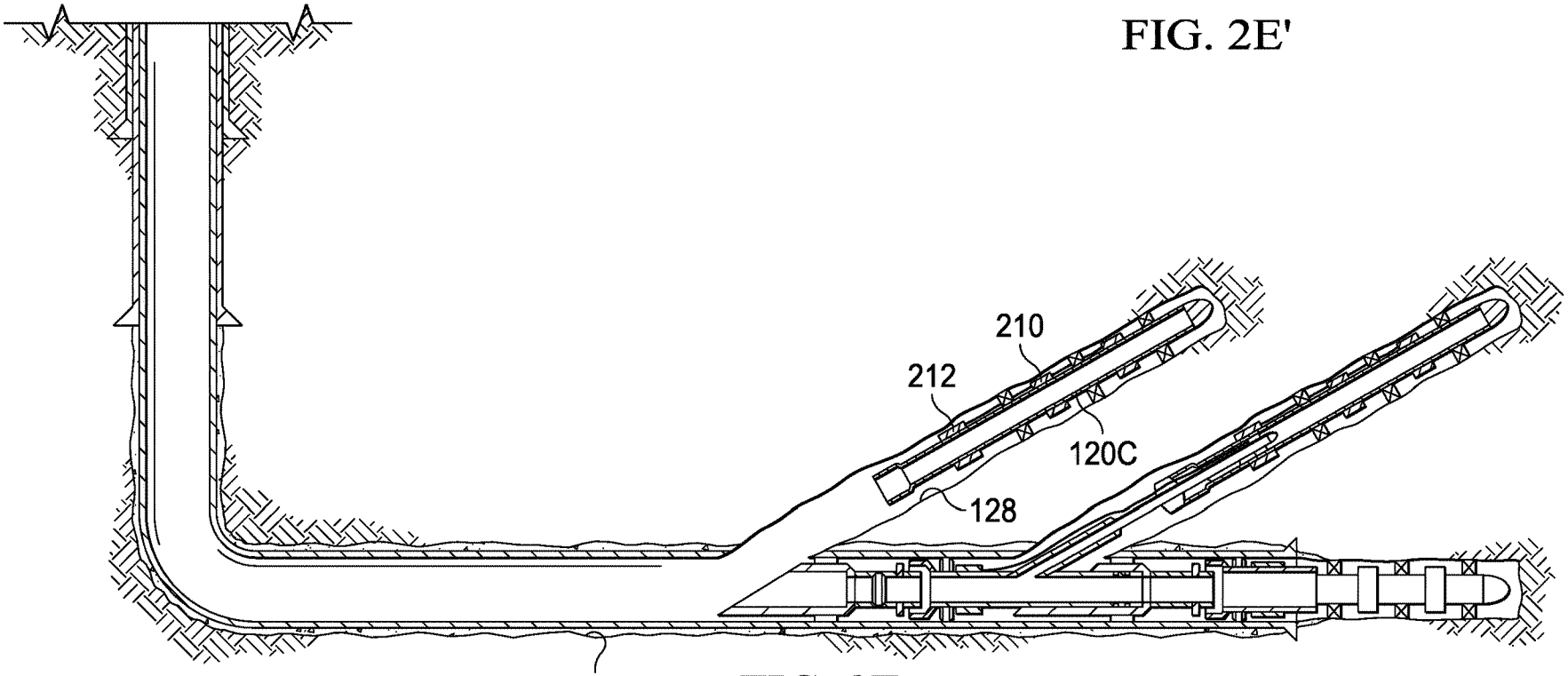

In some embodiments, where a multilateral wellbore includes multiple lateral boreholes, a second lateral borehole, such as lateral borehole 128 of FIG. 1 is also drilled through the formation and a second lateral completion is run into the lateral wellbore. In that regard, FIG. 2E illustrates a second lateral completion 120C deployed in lateral borehole 128 of wellbore 106. Second lateral completion 120C includes a component 210 (such as a valve, a sensor, or another type of component) and an inductive coupler 212 configured to provide electrical conduit to components of second lateral completion 120C. FIG. 2E' is a circuit diagram of electrical conduits of the multilateral completion system illustrated in FIG. 2E. In the embodiment of FIG. 2E', line 260 represents an electrical conduit from inductive coupler 212 to other components of second lateral completion 120C.

Figure 2F:
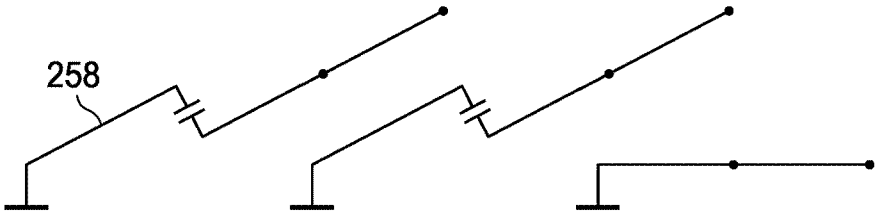
Figure 2F:
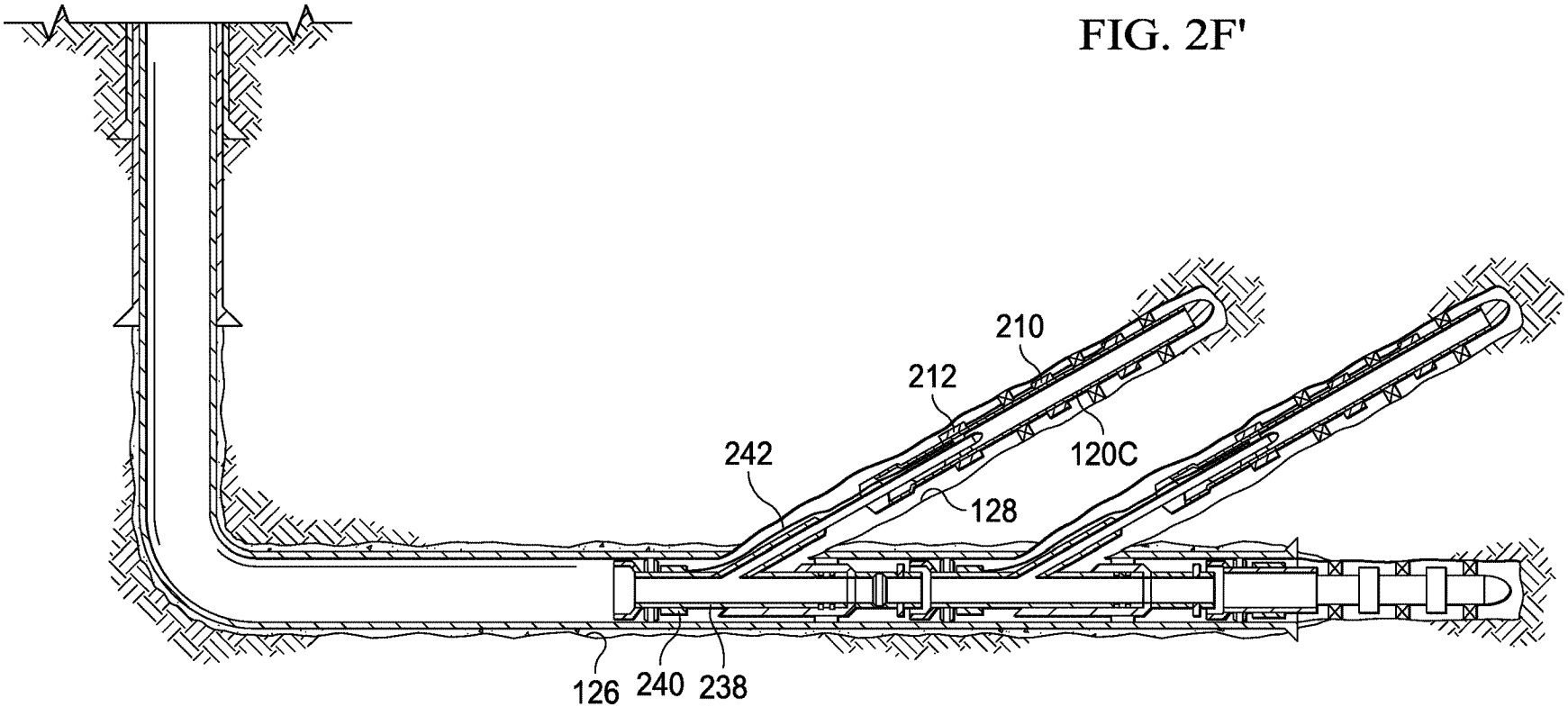

A second junction with lateral connectivity is then run into the main borehole and the lateral borehole. In that regard, FIG. 2F illustrates a second junction 238 having an inductive coupler 240 and an electrical conduit 242 deployed near a junction of main borehole 126 and lateral borehole 128. More particularly, electrical conduit 242 runs through an inner diameter of lateral borehole 128 and is connected to inductive coupler 212 to electrically connect components of second lateral completion 120C, such as component 210. FIG. 2F' is a circuit diagram of electrical conduits of the multilateral completion system illustrated in FIG. 2F. In the embodiment of FIG. 2F', line 258 represents an electrical conduit from inductive coupler 240 to inductive coupler 212. In some embodiments, where the multilateral completion system is deployed in a multilateral wellbore having two lateral boreholes, tests are performed on components of the multilateral completion system. For example, running tool 291 of FIG. 2D is run into the wellbore and inductive coupler 294 of FIG. 2D is utilized to perform tests on components of the multilateral completion system. Additional descriptions of operations performed to test components of the multilateral completion system are provided herein and are illustrated in at least FIG. 2D.

Figure 2G:
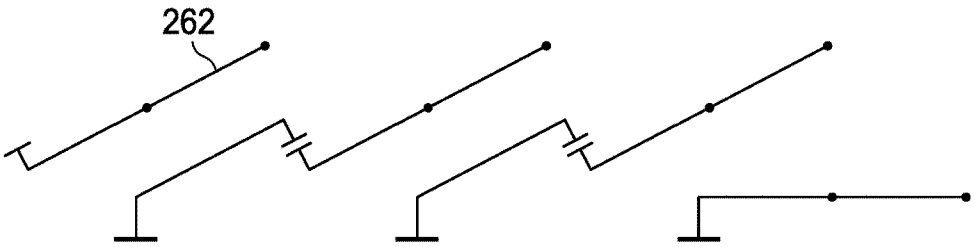
Figure 2G:
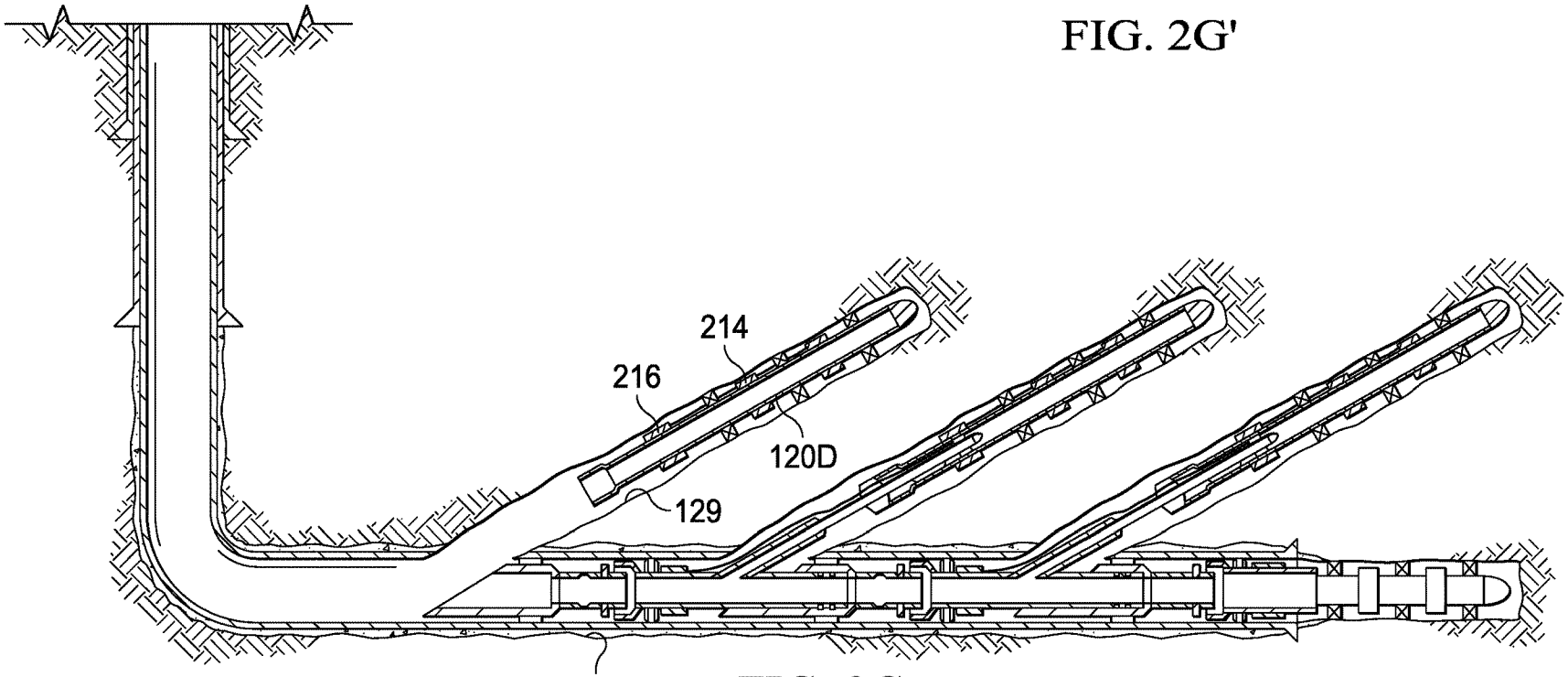

In some embodiments, where a multilateral wellbore includes more than two lateral boreholes, a third lateral borehole, such as lateral borehole 129 of FIG. 1 is also drilled through the formation and a third lateral completion is run into the lateral wellbore. In that regard, FIG. 2G illustrates a third lateral completion 120D deployed in lateral borehole 129 of wellbore 106. Third lateral completion 120D includes a component 214 (such as a valve, a sensor, or another type of component) and an inductive coupler 216 configured to provide electrical conduit to components of third lateral completion 120D, such as component 214. In that regard, FIG. 2G' is a circuit diagram of electrical conduits of the multilateral completion system illustrated in FIG. 2G. In the embodiment of FIG. 2G', line 262 represents an electrical conduit from inductive coupler 216 to other components of third lateral completion 120D.

Figure 2H:
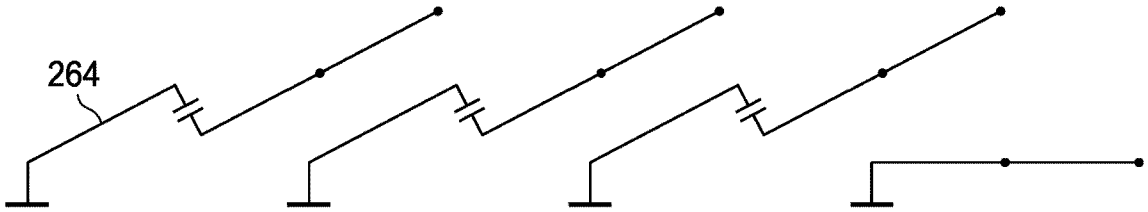
Figure 2H:
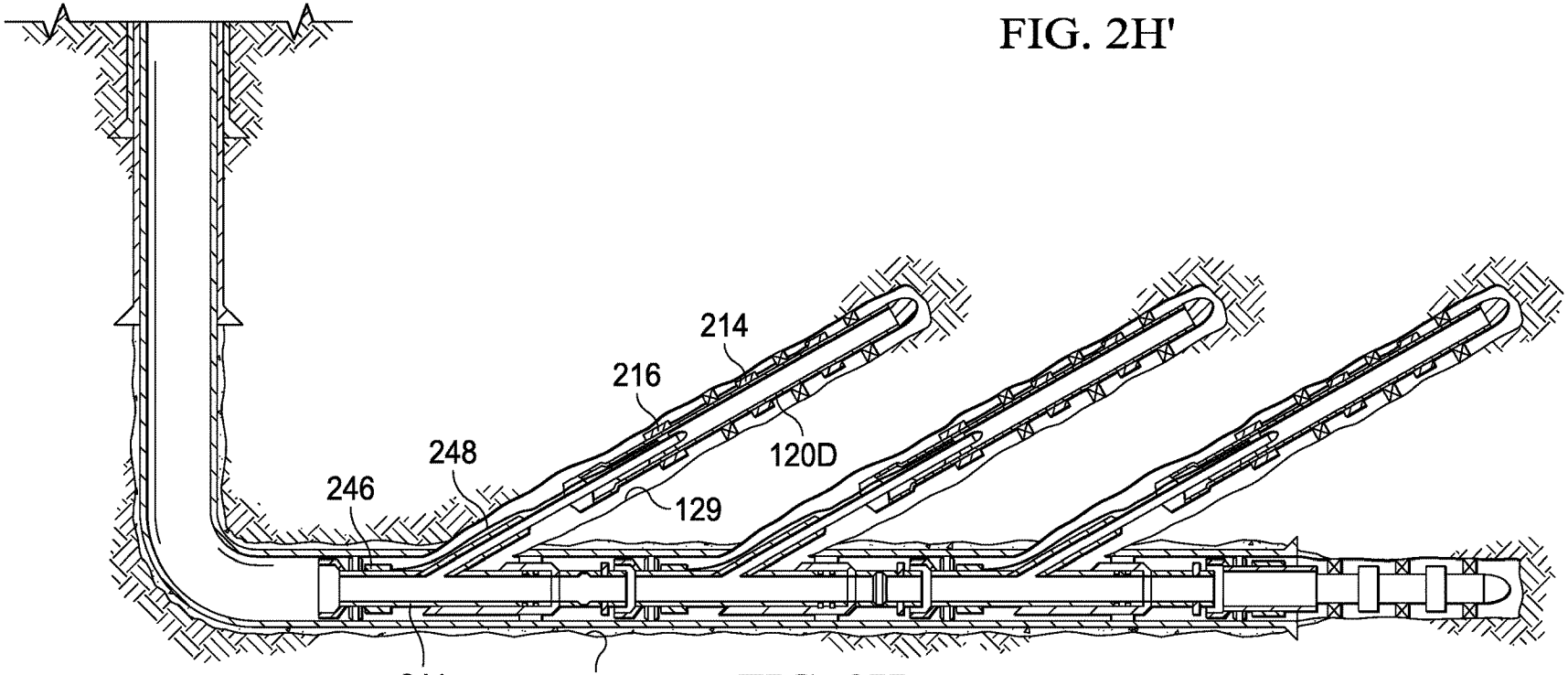
Figure 2I:
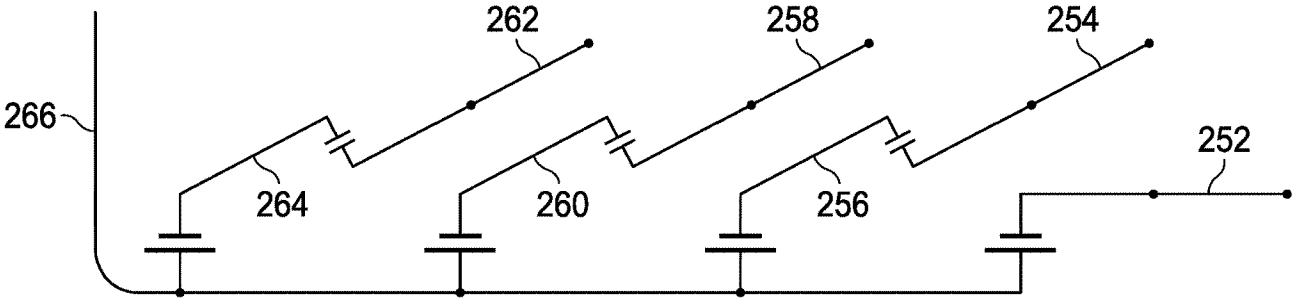
Figure 2I:
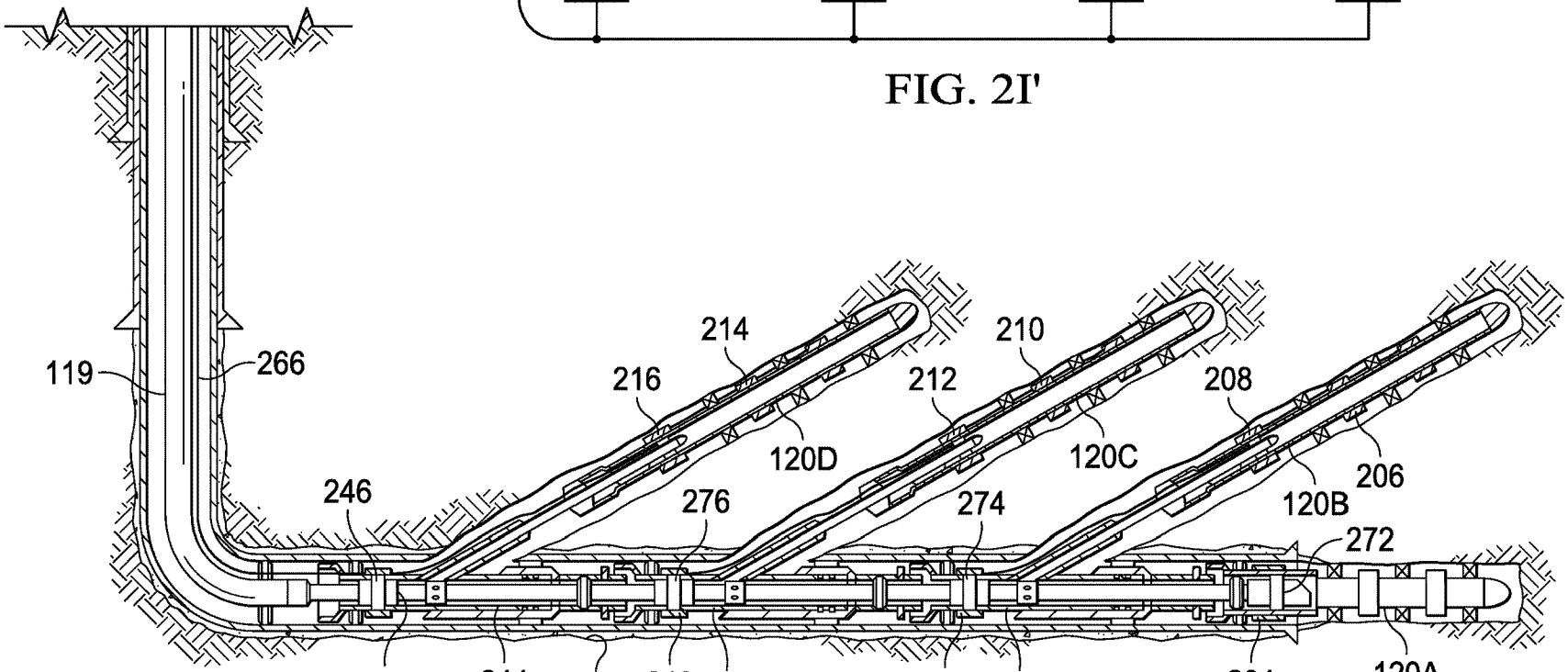

A third junction with lateral connectivity is then run into the main borehole and the lateral borehole. In that regard, FIG. 2H illustrates a third junction 244 having an inductive coupler 246 and an electrical conduit 248 deployed near a junction of main borehole 126 and lateral borehole 129. More particularly, electrical conduit 248 runs through an inner diameter of lateral borehole 129 and is connected to inductive coupler 216 to electrically connect components of third lateral completion 120D, such as component 214. In that regard, FIG. 2H' is a circuit diagram of electrical conduits of the multilateral completion system illustrated in FIG. 2H. In the embodiment of FIG. 2H', line 264 represents an electrical conduit from inductive coupler 246 to inductive coupler 216. In some embodiments, where the multilateral completion system is deployed in a multilateral wellbore having three lateral boreholes, tests are performed on components of the multilateral completion system. For example, running tool 291 of FIG. 2D is run into the wellbore and inductive coupler 294 of FIG. 2D is utilized to test components of the multilateral completion system. Additional descriptions of operations performed to test components of the multilateral completion system are provided herein and are illustrated in at least FIG. 2D.

A final completion having inductive couplers coupled to different sections of the final completion is deployed downhole to electrically connect to the inductive couplers deployed at different junctions. In that regard, FIG. 2I illustrates final completion 119 having inductive couplers 272, 274, 276, and 278 deployed in main borehole 126. More particularly, inductive couplers 272, 274, 276, and 278 are inductively coupled to inductive couplers 204, 224, 240, and 246 to electrically connect components of main bore completion 120A, first lateral completion 120B, second lateral completion 120C, and third lateral completion 120D to final completion 119. Further, inductive couplers 272, 274, 276, and 278 of final completion 119 are positioned to couple to inductive couplers 204, 224, 240, and 246 to establish parallel connection of main bore completion 120A and lateral completions 120B-120D. Further, electrical conduits of final completion 119 run through the inner diameter of junctions 222, 238, and 244. In the embodiment of FIG. 2I, communication with any sensor or device on any of main bore completion 120A or lateral completions 120B-120D traverses two pairs of inductive couplers. For example, power and communication to component (sensor) 206 of first lateral completion 120B traverse through inductive couplers 224 and 208, whereas power and communication to component (sensor) 210 of second lateral completion 120C traverse through inductive couplers 240 and 212. Further, in the embodiment of FIG. 2I, the lateral completions are connected in parallel, which reduces or minimizes the number of inductive coupler jumps (as shown in FIG. 2I'), thereby providing a more efficient power/signal transmission to each lateral. Although multilateral completion system 120 of FIG. 2I has three lateral completions 120B-120D, in some embodiments, multilateral completion system 120 includes a different number of lateral completions. Further, although final completion 119 has four inductive couplers 272, 274, 276, and 278, in some embodiments, final completion 119 has a different number of inductive couplers coupled to inductive couplers of junctions of multilateral completion system 120.

FIG. 2I' is a circuit diagram of electrical conduits of the multilateral completion system illustrated in FIG. 2I. In the embodiment of FIG. 2I', electrical conduit of final completion 119 is illustrated by line 266. Moreover, additional electrical conduits of multilateral completion system 120 of FIG. 2I are represented by lines 252, 254, 256, 258, 260, 262, and 264. As shown in FIG. 2I', electrical conduits 252 (electrical conduit from final completion 119 to main bore completion 120A of FIG. 2I), 256 (electrical conduit from final completion 119 to lateral completion 120B of FIG. 2I), 260 (electrical conduit from final completion 119 to lateral completion 120C of FIG. 2I), and 264 (electrical conduit from final completion 119 to lateral completion 120D of FIG. 2I) are established in parallel. The parallel connection of electrical conduits 252, 256, 260, and 264 limits a loss of electrical connectivity or damage to one of the electrical conduits 252, 256, 260, or 264 to a possible local loss of electrical connectivity of components of the corresponding completion, but would not affect electrical connectivity of other lateral completions. Further, the parallel connection of electrical conduits 252, 256, 260, and 264 reduces or minimizes the number of inductive coupler jumps from electrical conduit 266 to components of main bore completion 120A and lateral completions 120B-120D, thereby reducing or minimizing signal attenuation and power loss. Although FIGS. 2A'-2I' illustrate a process establishing electrical conduits of three lateral completions, the process may be utilized to establish parallel electrical conduits of a different number of lateral completion systems.

Figure 3A:
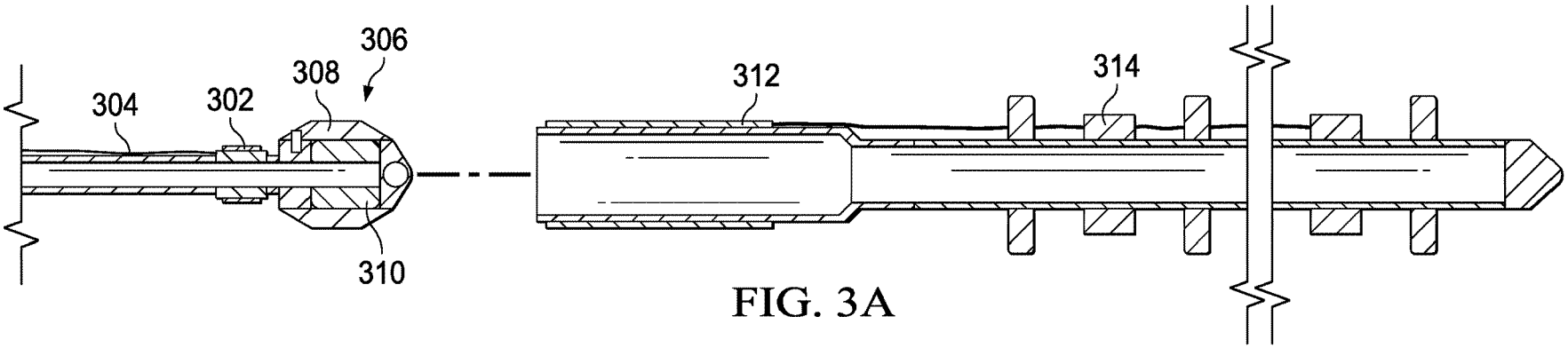
FIGS. 3A-3B illustrate a process to deploy one configuration of inductive couplers.
Figure 3B:
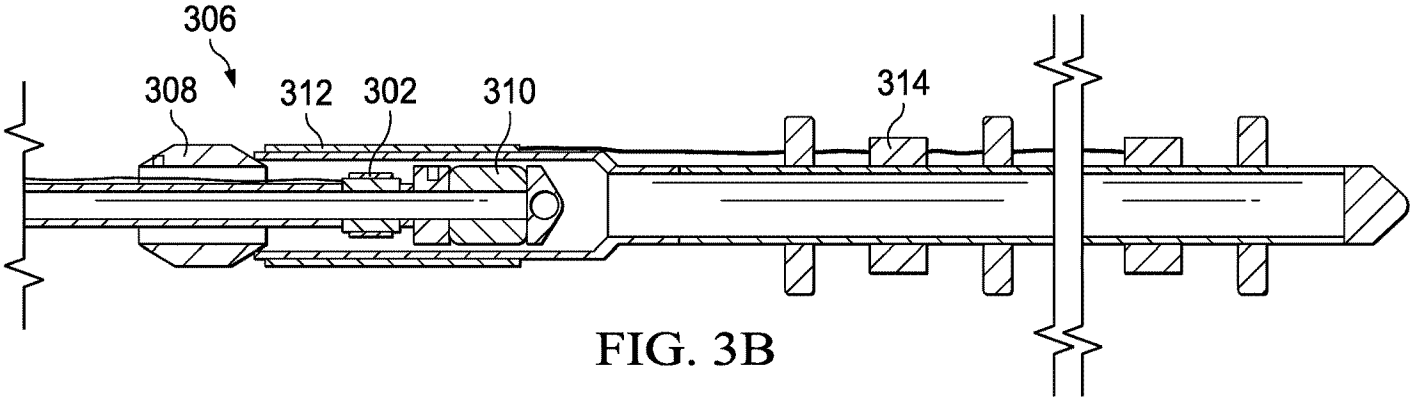

FIGS. 3A-3B illustrate a process to deploy one configuration of inductive couplers. As shown in FIG. 3A, a male inductive coupler 302 is coupled to an electrical cable 304 and a bull nose shrouded seal assembly 306 having a shroud 308 and a swell packer 310. As shown in FIG. 3B, the male inductive coupler 302 is inserted into a female inductive coupler 312 to provide power and communication to components 314, such as valves, sensors, and other devices. In some embodiments, female inductive coupler 312 is an inductive coupler of a lateral completion, such as first lateral completion 120B of FIG. 1. In the embodiment of FIGS. 3A and 3B, bull nose shrouded seal assembly 306 is inserted into female inductive coupler 312 as shroud 308 is peeled away exposing a swell seal element 310, such as a swell packer.

Figure 3C:
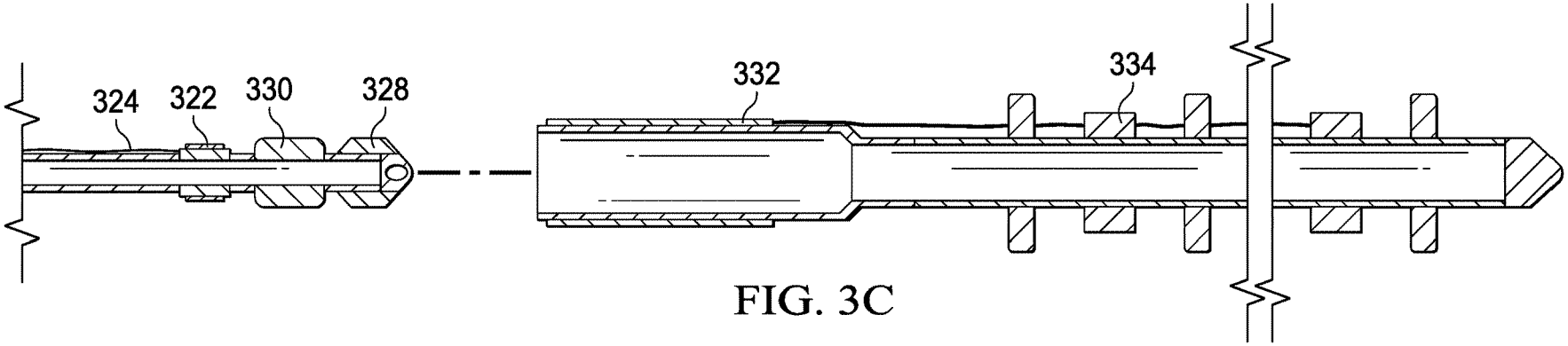
FIGS. 3C-3D illustrate a process to deploy another configuration of inductive couplers.
Figure 3D:
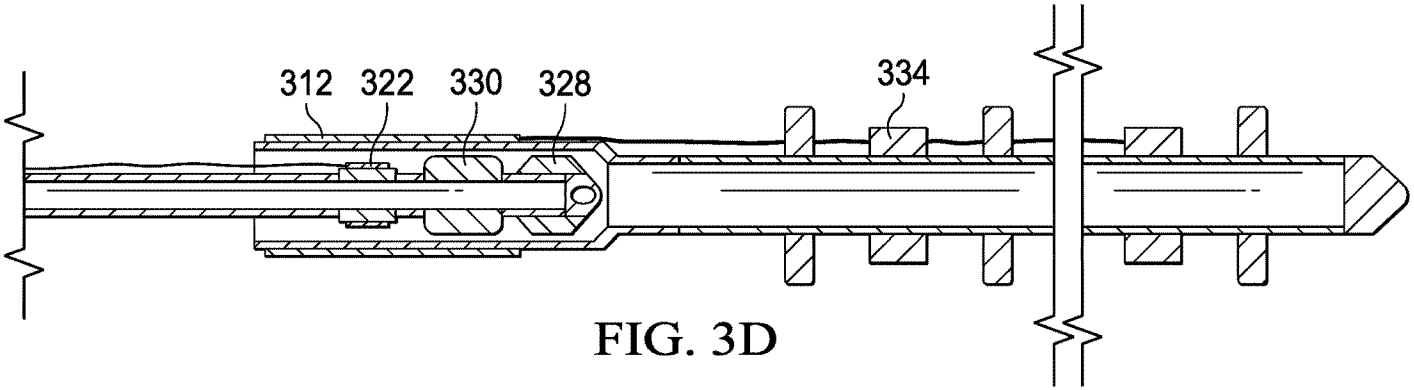

FIGS. 3C-3D illustrate a process to deploy another configuration of inductive couplers. FIG. 3C, similar to FIG. 3A, illustrates a male inductive coupler 322 that is coupled to an electrical cable 324, a bull nose 328, and a seal element 330, such as a swell packer. As shown in FIG. 3D, male inductive coupler 322 is inserted into a female inductive coupler 332 to provide power to components 334, such as valves, sensors, and other devices. In some embodiments, female inductive coupler 332 is an inductive coupler of a lateral completion, such as first lateral completion 120B of FIG. 1. In the embodiment of FIGS. 3C and 3D, bull nose 328 is inserted into female inductive coupler 332 exposing swell seal element 330.

Figure 4:
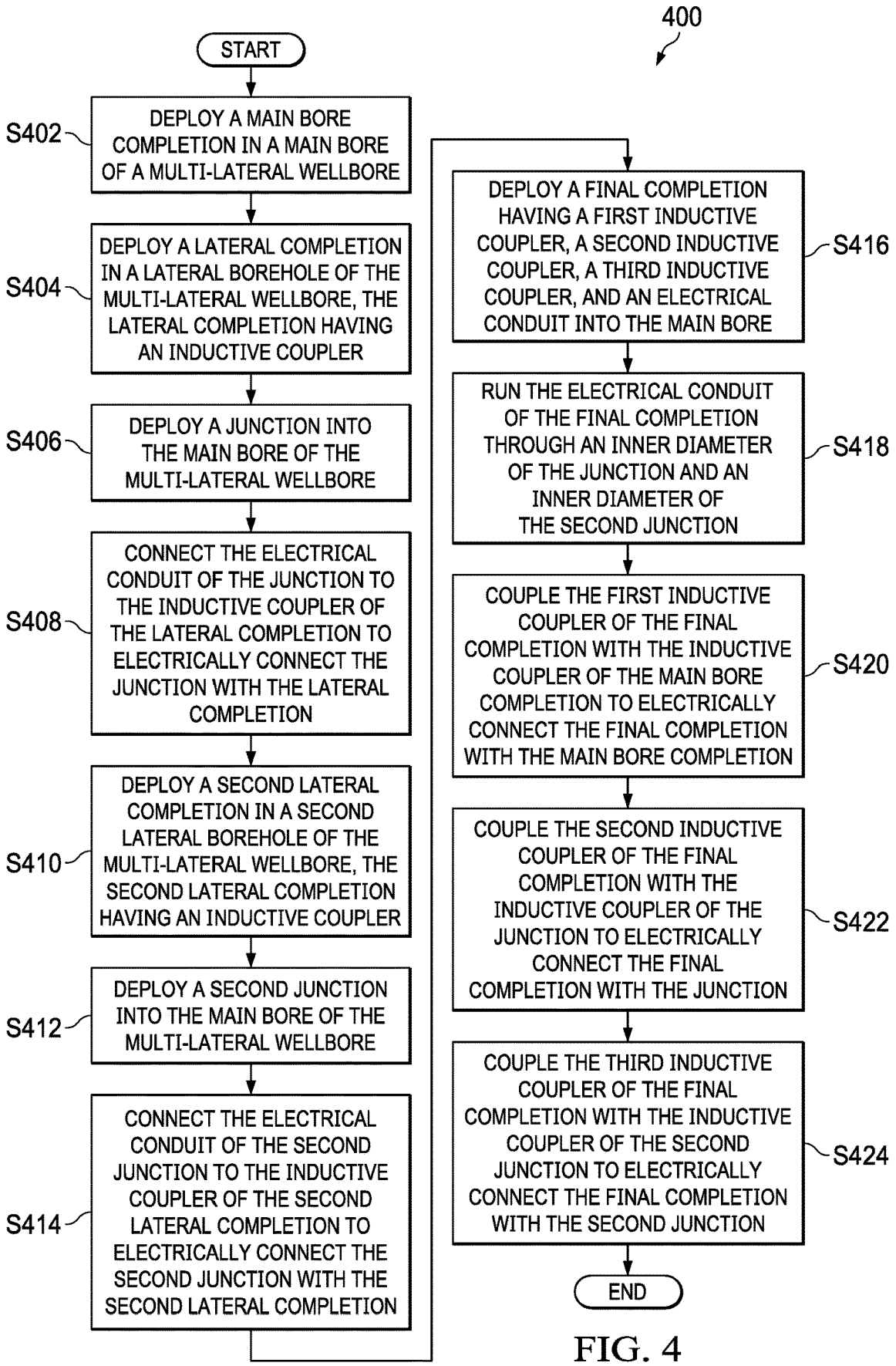
FIG. 4 is a flowchart of a process to deploy a multilateral completion system, such as the multilateral completion systems illustrated in FIG. 1.

FIG. 4 is a flow chart 400 of a process to deploy a multilateral completion system, such as the multilateral completion systems illustrated in FIG. 2. Although the operations in the process 400 are shown in a particular sequence, certain operations may be performed in different sequences or at the same time where feasible.

At block S402, a main bore completion is deployed in a main bore of a multilateral wellbore. The main bore completion includes an inductive coupler. FIG. 2A, for example, illustrates main bore completion 120A deployed in main borehole 126. At block S404, a lateral completion is deployed in a lateral borehole of the multilateral wellbore. FIG. 2B, for example, illustrates first lateral completion 120B deployed in lateral borehole 127. At block S406, a junction is deployed into the main bore of the multilateral wellbore. FIG. 2C, for example, illustrates first junction 222 having an inductive coupler 224 and an electrical conduit 226 running through an inner diameter of first lateral borehole 127. At block S408, the electrical conduit of the junction is connected to the inductive coupler of the lateral completion to electrically connect the junction with the lateral completion. FIG. 2C, for example, illustrates connecting electrical conduit 226 of first junction 222 to inductive coupler 208 of first lateral completion 120B to electrically connect first junction 222 to first lateral completion 120B. In some embodiments, one or more tests are performed on the deployed components of the multilateral completion system. In that regard, FIG. 2D illustrates deploying running tool 291 and inductive coupler 294 to test different deployed components of multilateral completion system 120.

In some embodiments, a running tool having a test apparatus is run into the multilateral wellbore to perform tests on one or more components of the multilateral wellbore before the installation of additional components and lateral completions. FIG. 2D, for example, illustrates deploying a work string 123 having running tool 291 and inductive coupler 294 into wellbore 106. In the embodiment of FIG. 2D, inductive coupler 294 is coupled to inductive coupler 224 of first junction 222 to perform tests on inductive coupler 224 and/or other components of first junction 222. In some embodiments, inductive coupler 294 is also utilized to test additional components of multilateral completion system 120 that are directly or indirectly connected to first junction 222, such as component 206 of first lateral completion 120B, inductive coupler 208 of first lateral completion 120B, electrical conduit from first junction 222 to first lateral completion 120B, component 202 of main bore completion 120A, inductive coupler 204 of main bore completion 120A, electrical conduit from first junction 222 to main bore completion 120, and other components that are directly or indirectly connected to first junction 222. In some embodiments, test apparatus is also utilized to test one or more components of main bore completion 120A, and/or components that are directly or indirectly connected to main bore completion 120A. In some embodiments, test apparatus is also utilized to test one or more components of lateral borehole completion 120B, and/or components that are directly or indirectly connected to lateral bore completion 120B. In some embodiments, inductive coupler 294 is utilized to perform one or more tests and to determine the connectivity of different components and electrical conduits of multilateral completion system 120. In some embodiments, a determination of whether a component of multilateral completion system 120 meets or exceeds a threshold performance level is made for one or more components of multilateral completion system 120. The running tool is subsequently retrieved from the multilateral wellbore after performance of the test on the multilateral completion system, and before additional components, such as additional lateral completions are deployed downhole.

At block S410, a second lateral completion is deployed in a second lateral borehole of the multilateral wellbore. FIG. 2E, for example, illustrates second lateral completion 120C deployed in lateral borehole 128 of wellbore 106.

At block S412, a second junction is deployed into the main bore of the multilateral wellbore. FIG. 2F, for example, illustrates second junction 238 having inductive coupler 240 and electrical conduit 242 deployed near a junction of main borehole 126 and lateral borehole 128. At block S414, the electrical conduit of the second junction is connected to the inductive coupler of the second lateral completion to electrically connect the second junction with the second lateral completion. FIG. 2F, for example, illustrates connecting electrical conduit 242 of second junction 238 to inductive coupler 212 of second lateral completion 120C to electrically connect second junction 238 to second lateral completion 120C. More particularly, electrical conduit 242 runs through an inner diameter of lateral borehole 128 and is connected to inductive coupler 212 to electrically connect components of second lateral completion 120C, such as component 210. In the embodiment of FIG. 2F, first lateral completion 120B and second lateral completion 120C are connected in parallel to each other. In some embodiments, one or more tests are performed on the deployed components of the multilateral completion system. In one or more of such embodiments, operations illustrated in FIG. 2D and described herein are performed to test the performance of the second lateral completion and the overall multilateral completion system after installation of the second lateral completion.

In some embodiments, additional lateral completions are deployed in additional lateral boreholes. For example, FIGS. 2G-2H illustrate deploying a third lateral completion in a third lateral borehole. In one or more embodiments, additional junctions are also deployed, where a junction is deployed near each lateral borehole. In one or more of such embodiments, each additional junction has an electrical conduit that runs through an interior diameter of a nearby lateral borehole to electrically connect components of a lateral completion deployed in the nearby lateral borehole to the respective junction. In the embodiment of FIG. 2I, all branches, main bore, first, second, and third lateral completions 120A, 120B, 120C, and 120D are connected in parallel to each other.

At block S416, a final completion having a first inductive coupler, a second inductive coupler, a third inductive coupler, and an electrical conduit is deployed into the main bore. Moreover, the first inductive coupler, the second inductive coupler, and the third inductive coupler are spaced out such that each inductive coupler lands across an inductive coupler of a junction to establish parallel electrical connections of multiple lateral completions of the multilateral completion system. FIG. 2I, for example, illustrates deploying final completion 119 having inductive couplers 272, 274, 276, and 278 into main borehole 126. Further, inductive couplers 272, 274, 276, and 278 are positioned to land across and couple to inductive couplers 204, 224, 240, and 246. At block S418, the electrical conduit of the final completion is run through an inner diameter of the junction and an inner diameter of the second junction. FIG. 2I, for example, illustrates electrical conduit 266 of final completion 119 running through inner diameters of first junction 222, second junction 238, and third junction 244, and electrically connecting inductive coupler 204 of main borehole 126. In some embodiments, where a different number of junctions are deployed in the main borehole, such as main borehole 126, electrical conduit 266 runs through each inner diameter of each junction deployed in the main bore. At block S420, the first inductive coupler of the final completion is coupled with the inductive coupler of the main bore completion to electrically connect the final completion with the main bore completion. FIG. 2I, for example, illustrates inductive coupler 272 of final completion 119 electrically coupled to inductive coupler 204 of main bore completion 120A.

At block S422, the second inductive coupler of the final completion is coupled with the inductive coupler of the junction to electrically connect the final completion with the junction. FIG. 2I, for example, illustrates inductive coupler 274 coupled to inductive coupler 224 of first junction 222 to electrically connect final completion 119 to first junction 222, which in turn is electrically connected to first lateral completion 120B. At block S424, the third inductive coupler of the final completion is coupled with the inductive coupler of the second junction to electrically connect the final completion with the second junction. In the embodiment of FIG. 2I, inductive coupler 276 of final completion 119 is coupled to inductive coupler 240 of second junction 238 to electrically connect final completion 119 to second junction 238, which in turn is electrically connected to second lateral completion 120C. Further, in the embodiment of FIG. 2I, inductive coupler 278 of final completion 119 is coupled to inductive coupler 246 of third junction 244 to electrically connect final completion 119 to third junction 244, which in turn is electrically connected to third lateral completion 120D. In some embodiments, where a different number of junctions having inductive couplers are deployed, inductive couplers of final completion 119 are coupled to corresponding inductive couplers of the junctions to electrically connect all of the junctions to final completion 119.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowchart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, A multilateral completion system, comprising: a main bore completion having an inductive coupler; a lateral completion having an inductive coupler; a second lateral completion having an inductive coupler; a junction having an inductive coupler that is electrically connected to the inductive coupler of the lateral completion; a second junction having an inductive coupler that is electrically connected to the inductive coupler of the second lateral completion; a final completion having a first inductive coupler configured to couple to the inductive coupler of the main bore completion, a second inductive coupler configured to couple to the inductive coupler of the junction, a third inductive coupler configured to couple to the inductive coupler of the second junction, and an electrical conduit running through an inner diameter of the junction, wherein the main bore, the lateral completion and the second lateral completion are connected in parallel.

Clause 2, the multilateral completion system of clause 1, further comprising: a third lateral completion having an inductive coupler; and a third junction having an inductive coupler configured to couple to the inductive coupler of the third lateral completion, wherein the final completion further comprises a fourth inductive coupler configured to couple to the inductive coupler of the third junction.

Clause 3, the multilateral completion system of clause 2, wherein the lateral completion, the second lateral completion, and the third lateral completion are connected in parallel.

Clause 4, the multilateral completion system of any of clauses 1-3, wherein the electrical conduit of the final completion runs through an inner diameter of the second junction.

Clause 5, the multilateral completion system of any of clauses 1-4, wherein inductive couplers of the main bore, the lateral completion, and the junction are females, and wherein the inductive couplers of the final completion are males.

Clause 6, the multilateral completion system of any of clauses 1-5, wherein the first inductive coupler, the second inductive coupler, and the third inductive coupler of the final completion are positioned to land across from the inductive coupler of the main bore completion, the inductive coupler of the lateral completion, and the inductive coupler of the second lateral completion, respectively, to connect the lateral completion, the second lateral completion, and the main bore completion in parallel Clause 7, a method to deploy a multilateral completion system, the method comprising: deploying a main bore completion in a main bore of a multilateral wellbore, the main bore completion comprising an inductive coupler; deploying a lateral completion in a lateral borehole of the multilateral wellbore, the lateral completion comprising an inductive coupler; deploying a junction into the main bore of the multilateral wellbore, the junction comprising an inductive coupler and an electrical conduit running through an inner diameter of the lateral borehole; connecting the electrical conduit of the junction to the inductive coupler of the lateral completion to electrically connect the junction with the lateral completion; deploying a second lateral completion in a second lateral borehole of the multilateral wellbore, the second lateral completion comprising an inductive coupler; deploying a second junction into the main bore of the multilateral wellbore, the second junction comprising an inductive coupler and an electrical conduit through an inner diameter of the second lateral borehole; connecting the electrical conduit of the second junction to the inductive coupler of the second lateral completion to electrically connect the second junction with the second lateral completion; deploying a final completion having a first inductive coupler, a second inductive coupler, a third inductive coupler, and an electrical conduit into the main bore; running the electrical conduit of the final completion through an inner diameter of the junction and an inner diameter of the second junction; coupling the first inductive coupler of the final completion with the inductive coupler of the main bore completion to electrically connect the final completion with the main bore completion coupling the second inductive coupler of the final completion with the inductive coupler of the junction to electrically connect the final completion with the junction, wherein the lateral completion and the second lateral completion are connected in parallel; and coupling the third inductive coupler of the final completion with the inductive coupler of the second junction to electrically connect the final completion with the second junction.

Clause 8, the method of clause 7, wherein the final completion comprises a fourth inductive coupler, the method further comprising: deploying a third lateral completion in a third lateral borehole of the multilateral wellbore, the third lateral completion comprising an inductive coupler; deploying a third junction into the main bore of the multilateral wellbore, the third junction comprising an inductive coupler and an electrical conduit through an inner diameter of the third lateral borehole; connecting the electrical conduit of the third junction to the inductive coupler of the third lateral completion to electrically connect the third junction with the third lateral completion; running the electrical conduit of the final completion through an inner diameter of the third junction; and coupling the fourth inductive coupler of the final completion with the inductive coupler of the third junction to electrically connect the final completion with the third junction.

Clause 9, the method of clause 8, further comprising connecting the lateral completion, the second lateral completion, and the third lateral completion in parallel.

Clause 10, the method of any of clauses 7-9, further comprising: running in a running tool having a test apparatus into the multilateral wellbore; performing, with the test apparatus, a test on the multilateral completion system; and retrieving the running tool from the multilateral wellbore after performance of the test on the multilateral completion system, wherein the final completion is deployed into the main bore after retrieval of the running tool.

Clause 11, the method of clause 10, wherein performing the test on the multilateral completion system comprises running the running tool into the main bore; performing, with the test apparatus, a first test on a component disposed in the main bore; running the running tool into the lateral borehole; performing, with the test apparatus, a second test on a second component disposed in the lateral borehole; and retrieving the running tool after performance of the first test and the second test, wherein the second lateral completion is deployed into the main bore after retrieval of the running tool.

Clause 12, the method of clause 11, further comprising: after deploying the second lateral completion, running the running tool into the second lateral borehole; performing, with the test apparatus, a third test on a third component disposed in the second lateral borehole; and retrieving the running tool after performance of the third test, wherein the final completion is deployed into the main bore after retrieval of the running tool.

Clause 13, the method of clauses 11 or 12, wherein performing the test on the multilateral completion system comprises performing, with the test apparatus, a third test on an electrical connectivity of the junction.

Clause 14, the method of clause 13, wherein performing the test comprises determining whether performance of a component of the multilateral completion system meets or exceeds a threshold performance level of the component.

Clause 15, a multilateral completion system, comprising: a main bore completion having an inductive coupler; a lateral completion having an inductive coupler; a junction having an inductive coupler electrically connected to the inductive coupler of the lateral completion; and an electrical conduit disposed in the interior of the junction and electrically connected to the inductive coupler of the main bore completion and the inductive coupler of the lateral completion, wherein the lateral completion and the main bore completion are electrically connected in parallel.

Clause 16, the multilateral completion system of clause 15, further comprising: a second lateral completion having an inductive coupler; and a second junction having an inductive coupler electrically connected to the inductive coupler of the second lateral completion, wherein the electrical conduit is disposed in the interior of the second junction and is electrically connected to the inductive coupler of the second lateral completion, and wherein the lateral completion, the second lateral completion, and the main bore completion are electrically connected in parallel.

Clause 17, the multilateral completion system of clause 16, further comprising: a third lateral completion having an inductive coupler; and a third junction having an inductive coupler electrically connected to the inductive coupler of the third lateral completion, wherein the electrical conduit is disposed in the interior of the third junction and is electrically connected to the inductive coupler of the third lateral completion, and wherein the lateral completion, the second lateral completion, the third lateral completion, and the main bore completion are electrically connected in parallel.

Clause 18, the multilateral completion system of any of clauses 15-17, further comprising a final completion having a first inductive coupler electrically coupled to the inductive coupler of the main bore completion, and a second inductive coupler electrically coupled to the inductive coupler of the junction.

Clause 19, the multilateral completion system of clause 18, wherein the inductive coupler of the junction and the inductive coupler of the main bore completion are females, and wherein the first inductive coupler and the second inductive coupler of the final completion are males.

Clause 20, the multilateral completion system of clauses 18 or 19, wherein the first inductive coupler and the second inductive coupler of the final completion are positioned to land across from the inductive coupler of the main bore completion and the inductive coupler of the lateral completion, respectively, to connect the lateral completion and the main bore completion in parallel.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A multilateral completion system, comprising:

a main bore completion having an inductive coupler coupled to a seal element;

a lateral completion having an inductive coupler;

a second lateral completion having an inductive coupler;

a junction in the main bore, the junction having an inner diameter and having an inductive coupler that is electrically connected to the inductive coupler of the lateral completion;

a second junction in the main bore, the second junction inserted directly into a diverter, the second junction having a second inner diameter and having an inductive coupler that is electrically connected to the inductive coupler of the second lateral completion;

a final completion having a first inductive coupler configured to couple to the inductive coupler of the main bore completion, a second inductive coupler configured to couple to the inductive coupler of the junction, a third inductive coupler configured to couple to the inductive coupler of the second junction, and an electrical conduit running through each inner diameter of each junction in the main bore, wherein the main bore, the lateral completion and the second lateral completion are connected in parallel; wherein each lateral completion is electrically connected to the final completion consisting of two inductive electrical connections formed in part by one or more of the first inductive coupler, the second inductive coupler, or the third inductive coupler.

2. The multilateral completion system of claim 1, further comprising:

a third lateral completion having an inductive coupler; and a third junction having an inductive coupler configured to couple to the inductive coupler of the third lateral completion, wherein the final completion further comprises a fourth inductive coupler configured to couple to the inductive coupler of the third junction.

3. The multilateral completion system of claim 2, wherein the lateral completion, the second lateral completion, and the third lateral completion are connected in parallel.

4. The multilateral completion system of claim 1, wherein inductive couplers of the main bore, the lateral completion, and the junction are females, and wherein the inductive couplers of the final completion are males.

5. The multilateral completion system of claim 1, wherein the first inductive coupler, the second inductive coupler, and the third inductive coupler of the final completion are positioned to land across from the inductive coupler of the main bore completion, the inductive coupler of the lateral completion, and the inductive coupler of the second lateral completion, respectively, to connect the lateral completion, the second lateral completion, and the main bore completion in parallel.

6. A method to deploy a multilateral completion system, the method comprising:

deploying a main bore completion in a main bore of a multilateral wellbore, the main bore completion comprising an inductive coupler coupled to a seal element;

deploying a lateral completion in a lateral borehole of the multilateral wellbore, the lateral completion comprising an inductive coupler;

deploying a junction into the main bore of the multilateral wellbore, the junction comprising an inductive coupler and an electrical conduit running through an inner diameter of the lateral borehole;

connecting the electrical conduit of the junction to the inductive coupler of the lateral completion to electrically connect the junction with the lateral completion;

deploying a second lateral completion in a second lateral borehole of the multilateral wellbore, the second lateral completion comprising an inductive coupler;

deploying a second junction into the main bore of the multilateral wellbore, wherein the second junction inserted directly into a diverter, and the second junction comprising an inductive coupler and an electrical conduit through an inner diameter of the second lateral borehole;

connecting the electrical conduit of the second junction to the inductive coupler of the second lateral completion to electrically connect the second junction with the second lateral completion;

deploying a final completion having a first inductive coupler, a second inductive coupler, a third inductive coupler, and an electrical conduit into the main bore;

running the electrical conduit of the final completion through each inner diameter of each junction in the main bore;

coupling the first inductive coupler of the final completion with the inductive coupler of the main bore completion to electrically connect the final completion with the main bore completion;

coupling the second inductive coupler of the final completion with the inductive coupler of the junction to electrically connect the final completion with the junction, wherein the lateral completion and the second lateral completion are connected in parallel; and coupling the third inductive coupler of the final completion with the inductive coupler of the second junction to electrically connect the final completion with the second junction;

wherein each lateral completion is electrically connected to the final completion consisting of two inductive electrical connections formed in part by one or more of the first inductive coupler, the second inductive coupler, or the third inductive coupler.

7. The method of claim 6, wherein the final completion comprises a fourth inductive coupler, the method further comprising:

deploying a third lateral completion in a third lateral borehole of the multilateral wellbore, the third lateral completion comprising an inductive coupler;

deploying a third junction into the main bore of the multilateral wellbore, the third junction comprising an inductive coupler and an electrical conduit through an inner diameter of the third lateral borehole;

connecting the electrical conduit of the third junction to the inductive coupler of the third lateral completion to electrically connect the third junction with the third lateral completion;

running the electrical conduit of the final completion through an inner diameter of the third junction; and coupling the fourth inductive coupler of the final completion with the inductive coupler of the third junction to electrically connect the final completion with the third junction.

8. The method of claim 7, further comprising connecting the lateral completion, the second lateral completion, and the third lateral completion in parallel.

9. The method of claim 6, further comprising:

running in a running tool having a test apparatus into the multilateral wellbore;

performing, with the test apparatus, a test on the multilateral completion system; and retrieving the running tool from the multilateral wellbore after performance of the test on the multilateral completion system, wherein the final completion is deployed into the main bore after retrieval of the running tool.

10. The method of claim 9, wherein performing the test on the multilateral completion system comprises:

running the running tool into the main bore;

performing, with the test apparatus, a first test on a component disposed in the main bore;

running the running tool into the lateral borehole;

performing, with the test apparatus, a second test on a second component disposed in the lateral borehole; and retrieving the running tool after performance of the first test and the second test, wherein the second lateral completion is deployed into the main bore after retrieval of the running tool.

11. The method of claim 10, further comprising:

after deploying the second lateral completion, running the running tool into the second lateral borehole;

performing, with the test apparatus, a third test on a third component disposed in the second lateral borehole; and retrieving the running tool after performance of the third test, wherein the final completion is deployed into the main bore after retrieval of the running tool.

12. The method of claim 10, wherein performing the test on the multilateral completion system comprises performing, with the test apparatus, a third test on an electrical connectivity of the junction.

13. The method of claim 12, wherein performing the test comprises determining whether performance of a component of the multilateral completion system meets or exceeds a threshold performance level of the component.

14. A multilateral completion system, comprising:

a main bore completion having an inductive coupler coupled to a seal element;

a lateral completion having an inductive coupler;

a junction in the main bore, the junction is directly inserted into a diverter, and having an inner diameter and having an inductive coupler electrically connected to the inductive coupler of the lateral completion;

an electrical conduit disposed in the interior of the junction and electrically connected to the inductive coupler of the main bore completion and the inductive coupler of the lateral completion; and a final completion having an electrical conduit running through each inner diameter of each junction in the main bore and a first inductive coupler electrically coupled to the inductive coupler of the main bore completion; wherein each lateral completion is electrically connected to the final completion consisting of two inductive electrical connections formed in part by the inductive coupler of the final completion, wherein the lateral completion and the main bore completion are electrically connected in parallel.

15. The multilateral completion system of claim 14, further comprising:

a second lateral completion having an inductive coupler; and a second junction having an inductive coupler electrically connected to the inductive coupler of the second lateral completion, wherein the electrical conduit of the junction is further disposed in the interior of the second junction and is electrically connected to the inductive coupler of the second lateral completion, and wherein the lateral completion, the second lateral completion, and the main bore completion are electrically connected in parallel.

16. The multilateral completion system of claim 15, further comprising:

a third lateral completion having an inductive coupler; and a third junction having an inductive coupler electrically connected to the inductive coupler of the third lateral completion, wherein the electrical conduit of the junction is further disposed in the interior of the third junction and is electrically connected to the inductive coupler of the third lateral completion, and wherein the lateral completion, the second lateral completion, the third lateral completion, and the main bore completion are electrically connected in parallel.

17. The multilateral completion system of claim 14, wherein the final completion further comprises a second inductive coupler electrically coupled to the inductive coupler of the junction.

18. The multilateral completion system of claim 17, wherein the inductive coupler of the junction and the inductive coupler of the main bore completion are females, and wherein the first inductive coupler and the second inductive coupler of the final completion are males.

19. The multilateral completion system of claim 17, wherein the first inductive coupler and the second inductive coupler of the final completion are positioned to land across from the inductive coupler of the main bore completion and the inductive coupler of the lateral completion, respectively, to connect the lateral completion and the main bore completion in parallel.

* * * * *